US006926179B2

(12) United States Patent
Wagner, III et al.

(10) Patent No.: US 6,926,179 B2
(45) Date of Patent: Aug. 9, 2005

(54) AERATED RAPID FLOW DISPENSING CAP

(75) Inventors: George J. Wagner, III, 313 Coralberry Rd., Louisville, KY (US) 40207; Troy Cleaver, Louisville, KY (US)

(73) Assignee: George J. Wagner, III, Louisville, KY (US)

( * ) Notice: Subject to any disclaimer, the term of this patent is extended or adjusted under 35 U.S.C. 154(b) by 184 days.

(21) Appl. No.: 10/606,018

(22) Filed: Jun. 25, 2003

(65) Prior Publication Data

US 2004/0050883 A1 Mar. 18, 2004

Related U.S. Application Data

(60) Provisional application No. 60/411,198, filed on Sep. 17, 2002.

(51) Int. Cl.[7] ..... B67D 3/00; B65D 47/00; B65D 25/40

(52) U.S. Cl. ..... 222/481.5; 222/484; 222/546; 222/556; 222/568; 222/571; 222/543

(58) Field of Search ..... 222/481, 481.5, 222/482, 484, 546, 556, 543, 566–568, 571

(56) References Cited

U.S. PATENT DOCUMENTS

| | | | | |
|---|---|---|---|---|
| 639,832 A | | 12/1899 | Shearman | |
| 2,099,292 A | | 8/1936 | Brown | |
| 2,445,130 A | | 7/1948 | Turner | |
| 2,608,841 A | | 9/1952 | Rice | |
| 2,991,897 A | | 7/1961 | Burnett | |
| 3,190,511 A | | 6/1965 | Daly | |
| 3,750,915 A | * | 8/1973 | Kearney | 222/567 |
| 4,193,519 A | | 3/1980 | Dubach et al. | |
| 4,452,381 A | * | 6/1984 | Freeman | 222/465.1 |
| 5,072,861 A | * | 12/1991 | Jou | 222/481 |
| 5,249,611 A | | 10/1993 | Law | |
| 5,542,670 A | | 8/1996 | Morano | |
| 5,605,254 A | | 2/1997 | Wagner, III et al. | |
| 5,988,458 A | | 11/1999 | Messner | |

* cited by examiner

*Primary Examiner*—Michael Mar
*Assistant Examiner*—Patrick Buechner
(74) *Attorney, Agent, or Firm*—Camorland and Associates; Theresa Fritz Camorland

(57) ABSTRACT

An improved aerated dispensing cap provides an airway tube that does not become plugged when the bottle is turned abruptly for quick dispensing of liquid. This dispensing cap provides for smooth, controlled flow at all flow rates. It includes a dispensing tube and an airway tube having a small diameter lower portion and a large diameter upper portion.

20 Claims, 2 Drawing Sheets

AERATED RAPID FLOW DISPENSING CAP

This application claims priority from U.S. Provisional Patent Application Ser. No. 60/411,198, filed Sep. 17, 2002.

BACKGROUND

The present invention relates to dispensing caps, and, in particular, to an improvement over the cap shown in U.S. Pat. No. 5,605,254, which is hereby incorporated by reference. The cap shown in that referenced patent has been very popular and well-received by the industry, because it solves many problems that existed before it was invented, as described in that patent. However, one difficulty remains with that cap, and that is, if the person handling the bottle turns the bottle to pour in an extremely sudden or quick dispensing motion, as professional bartenders often do, the air tube becomes flooded, which hinders the free flow of liquid.

SUMMARY OF THE INVENTION

After three years of research and testing over one hundred prototypes, we have finally designed a cap that provides many of the benefits of the cap shown in U.S. Pat. No. 5,605,254, with the added benefit that its air vent does not choke off if the bottle is turned downwardly in a quick dispensing motion for rapid dispensing.

The present invention provides an aerated cap which may be sold mounted on a sealed bottle—not requiring a separate lid or separate neck for shipping and another for use. In a preferred embodiment, the dispensing cap includes an integral closure which permits the bottle and cap to simply be closed and refrigerated, eliminating the need for disassembly and washing of multipart dispensing caps before the bottle can be stored. The present invention provides a dispensing system which is easy to use and which provides smooth, controlled flow of product.

DESCRIPTION OF THE PREFERRED EMBODIMENT

Figure 6:
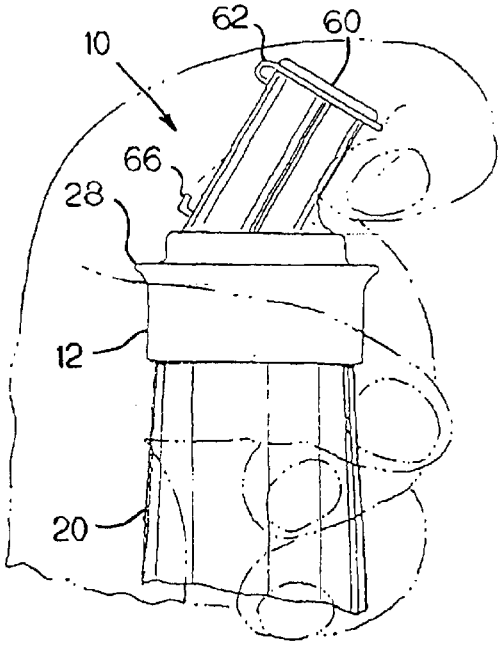
FIG. 6 is an enlarged, broken-away view showing a person holding the bottle of FIG. 5.
Figure 5:
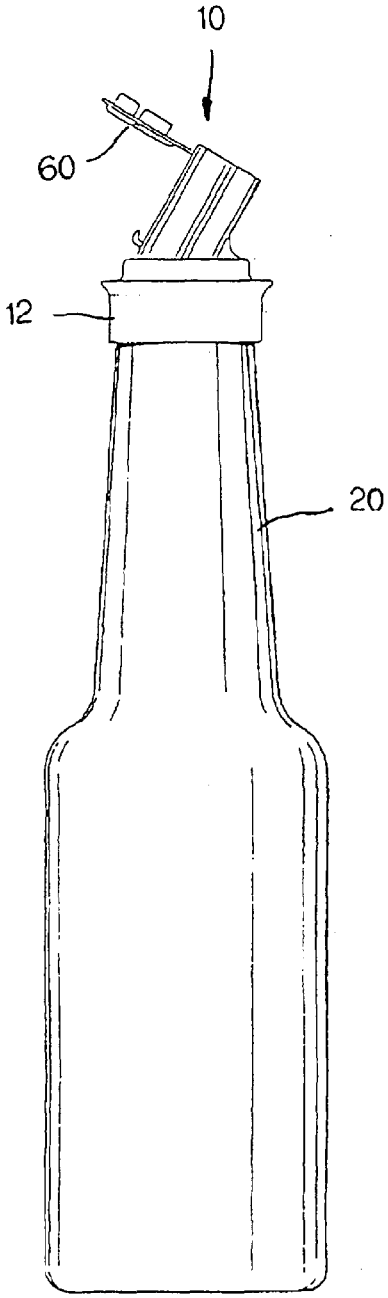
FIG. 5 is a side view of a bottle on which the cap of FIG. 1 has been mounted.

FIGS. 1–8 show an aerated dispensing cap 10, which has a substantially cylindrical base 12, defining a substantially vertical axis 14. On the inner surface of the base 12 is an inwardly-projecting annular ledge 16, for sealing against the top edge 18 of the bottle 20. On the interior of the cap 10, below the ledge 16, are internal threads 22, which mate with external threads 24 on the bottle 20. When the bottle 20 and cap 10 are sold, there preferably is a seal 26 across the top edge of the bottle 20, sealing the contents of the bottle against contamination. Before the user can begin dispensing liquid from the bottle, he will remove the cap 10, remove the seal 26, and then rethread the cap 10 onto the bottle 20. There is an outwardly-projecting flange 28 on the outer surface of the base 12, which helps a person grasp the bottle 20 without slipping. As shown in FIG. 6, the person grasps the neck of the bottle 20 below the flange 28 and uses his forefinger to flip open the closure on the cap 10 before dispensing the liquid.

The cap 10 defines a dispensing tube 30, which has an axis 31 that lies at an angle alpha to the vertical axis 14. The angle alpha preferably is greater than 90° and less than 180°, and most preferably between 100° and 160°. In this preferred embodiment, the angle alpha is 150°. An abrupt edge 32, having a sharp, acute angle, is formed on the interior surface of the cap 10, at the lower termination point of the dispensing tube 30. It is thought that this edge 32 may help cut off flow and eliminate drips when the bottle is turned toward the upright position. The lower termination point 32 of the dispensing tube 30 lies above the ledge 16, so it does not interfere with the seal 26. In this embodiment, the dispensing tube 30 has a circular cross-section.

The cap 10 also defines an elongated airway tube 40, which lies parallel to the dispensing tube 30. The airway tube 40 defines a lower termination point 42, which also lies above the ledge 16, so it does not interfere with the seal 26. The airway tube 40 has a small diameter lower portion 44 and a substantially larger diameter upper portion 46. The small diameter lower portion 44 lies at an angle to the larger diameter upper portion 46, with the lower portion 44 having a central axis parallel to the axis 14 of the base 12, while the upper portion 46 has a central axis parallel to the axis 31 of the dispensing tube 30.

The diameter of the small diameter lower portion 44 also is substantially less than the diameter of the dispensing tube 30. In this particular embodiment, the diameter of the lower portion 44 of the airway tube 40 is about half of the diameter of the upper portion 46 and about half of the diameter of the dispensing tube 30. Of course, the relative diameters may be adjusted, depending upon the viscosity of the liquid to be dispensed and the desired flow rate.

In this preferred embodiment, the upper portion 46 of the airway tube 40 has an oblong or rectangular cross-section, while the lower portion 44 has a circular cross-section. The small diameter lower portion 44 extends for a short distance, and the larger diameter upper portion 46 extends for a substantially greater distance, from the upper termination point 48 of the lower portion 44 to the upper termination point 50 of the airway tube 40. In this embodiment, the upper termination point 50 of the airway tube 40 is coplanar with the upper termination point 36 of the dispensing tube 30.

In this embodiment, the upper termination point 48 of the small diameter lower portion 44 of the airway tube 40 is coplanar with the lower termination point 32 of the dispensing tube, and the lower portion 44 extends downwardly below the lower termination point 32 of the dispensing tube 30. However, particularly for viscous liquids, it may be desirable for the small diameter lower portion 44 to have a very short height, so that it functions essentially as an orifice.

Figure 1:
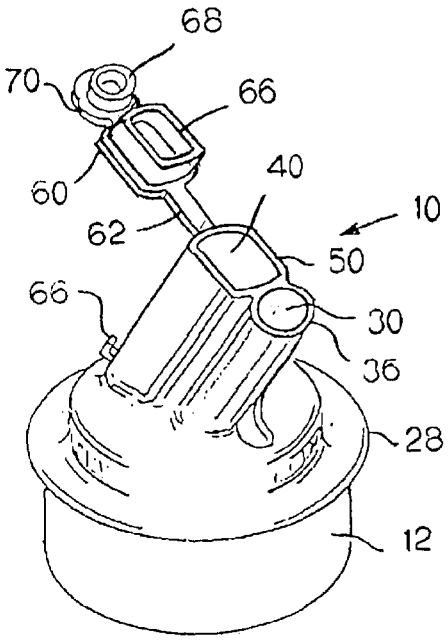
FIG. 1 is a perspective view of an aerated dispensing cap made in accordance with the present invention.
Figure 2:
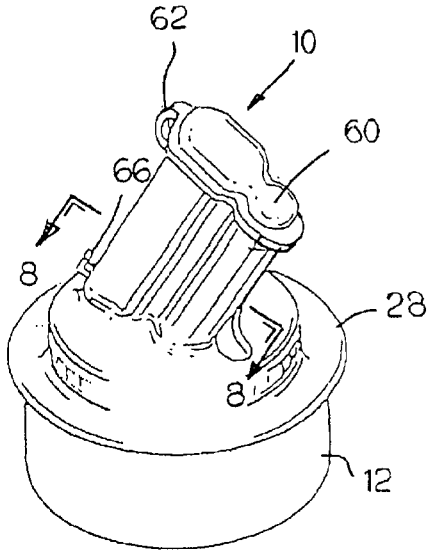
FIG. 2 is the same view as FIG. 1, but with the cap closed.
Figure 8:
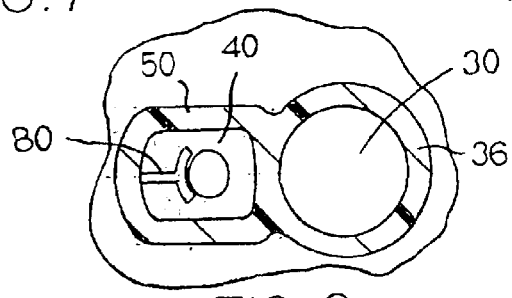
FIG. 8 is a view taken along the line 8—8 of FIG. 2.
Figure 3:
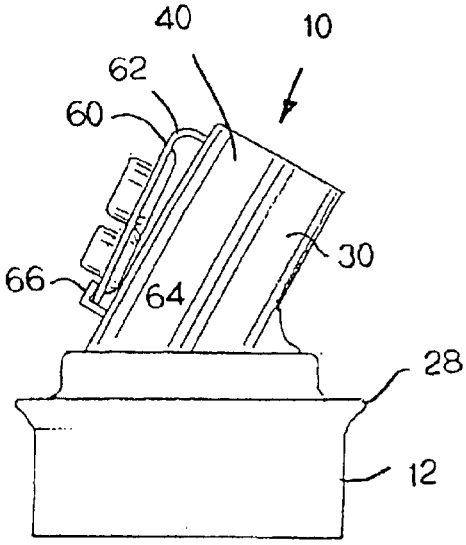
FIG. 3 is a side view of the cap of FIG. 1 with the closure completely retracted.
Figure 4:
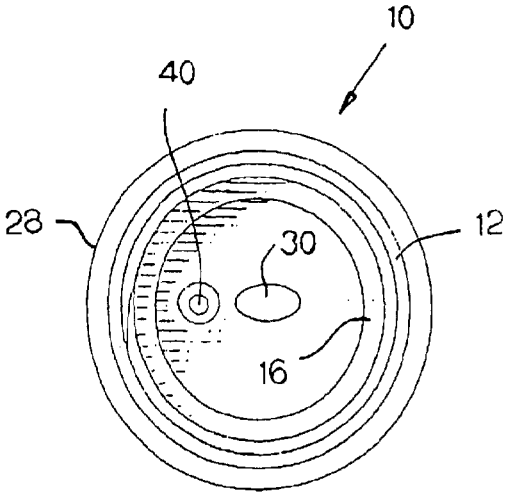
FIG. 4 is a bottom view of the cap of FIG. 1.
Figure 7:
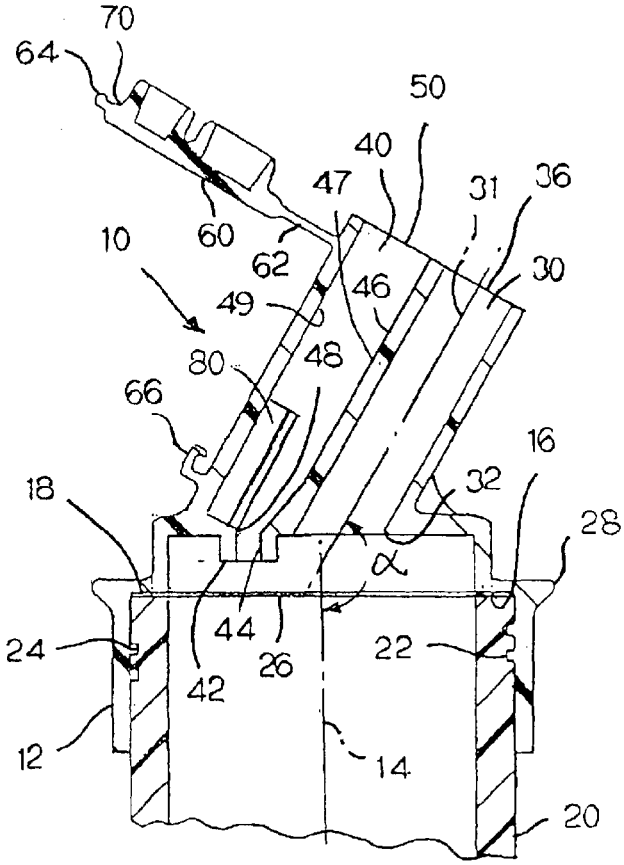
FIG. 7 is an enlarged, broken-away section view of the bottle and cap of FIG. 5.

A baffle 80, shown in FIGS. 7 and 8, extends upwardly from the small diameter lower portion 44 of the airway tube 40 part-way up inside the larger diameter upper portion 46. One side 47 of the airway tube 40 lies adjacent to the dispensing tube 30, and another side 49 of the airway tube 40 lies opposite to the dispensing tube 30. The baffle 80 extends upwardly from the opposite side 49 of the airway tube 40. The baffle 80 has a T-shaped cross-section forming a wall extending upwardly from the opposite side 49 of the small diameter portion 44, and the baffle 80 extends in a direction parallel to the axis 31 of the dispensing tube 30. It is believed that the baffle 80 helps resist or cut off the flow of liquid into the airway tube 40 when the bottle is turned upside down rapidly, while providing no appreciable resistance to air flow through the airway tube 40.

The cap 10 also includes an integral closure 60, connected to the rest of the cap 10 by a flexible web 62. The flexible web 62 permits the closure 60 to flex from the retracted position, shown in FIG. 3, in which a tab 64 at the end of the closure 60 is caught behind a hook 66 projecting outwardly from the outer surface of the cap 10, to the closed position, shown in FIGS. 2 and 6. The closure 60 defines first and second projections 66, 68 which fit into the upper outlet of the airway tube 40 and dispensing tube 30, respectively, with a snug fit when the closure is closed. The closure 60 also defines sealing surfaces 70, which seal against the outer edges 36, 50 of the dispensing tube 30 and airway tube 40 to close the cap 10 for storage. In this preferred embodiment, the upper termination points 36, 50 of the dispensing tube 30 and airway tube 40 are coplanar, so the sealing surfaces 70 are also coplanar, which provides for a good seal.

Once the seal 26 has been removed and the cap 10 has been replaced onto the bottle 20, the person can grasp the neck of the bottle as shown in FIG. 6 and use his forefinger to flip open the closure 60. He then may tilt the bottle downwardly to pour out the liquid. If he tilts the bottle very rapidly, a small amount of liquid may pass through the airway tube 40, while the majority of the liquid is passing through the dispensing tube 30. However, since the small diameter portion 44 of the airway tube 40 is very short, and the remainder of the airway tube 40 has a much larger diameter, the airway tube 40 does not become plugged. The small amount of liquid that passed through the small diameter portion 44 is simply directed out along the larger diameter portion 46 and is dispensed into a glass or other container along with the liquid flowing out of the dispensing tube. Thus, there is no "spitting" of any liquid that passes out the airway tube 40. Once the liquid begins pouring out of the bottle through the dispensing tube 30, air begins flowing into the bottle through the airway tube 40, and there is a smooth, controlled flow of liquid out the cap 10.

The foregoing embodiment is intended to be one example of a dispensing cap made in accordance with the present invention. It will be obvious to those skilled in the art that modifications may be made to the embodiment described above without departing from the scope of the present invention.

What is claimed is:

1. A one-piece dispensing cap, comprising:

a substantially cylindrical base, defining internal threads in its lower portion and having a substantially vertical axis, and defining an annular ledge on its inner surface above said threads for sealing against a vessel;

a dispensing tube in fluid communication with said base and having an axis which lies at an angle to the axis of the base, said dispensing tube having a lower termination point which lies above the annular ledge;

an elongated airway tube in fluid communication with said base and having a lower termination point which lies above said annular ledge, wherein said dispensing tube and said airway tube lie substantially parallel to each other and define upper termination points which are adjacent to each other, and wherein said elongated airway tube defines a small diameter lower portion, extending for a short distance, and a substantially larger diameter upper portion extending for a substantially greater distance from the small diameter lower portion to the upper termination point of the airway tube; and further comprising a baffle inside the larger diameter upper portion of said elongated airway tube adjacent said small diameter lower portion.

2. A one-piece dispensing cap as recited in claim 1, wherein the small diameter lower portion of the airway tube extends downwardly below the lower termination point of the dispensing tube.

3. A one-piece dispensing cap as recited in claim 1, wherein the dispensing tube is straight, having the same axis for its entire length.

4. A one-piece dispensing cap as recited in claim 1, and further comprising an integral closure, defining sealing surfaces which seal against both the airway tube and the dispensing tube.

5. A one-piece dispensing cap as recited in claim 4, wherein the upper termination points of said dispensing tube and said airway tube are coplanar.

6. A one-piece dispensing cap as recited in claim 4, wherein said closure includes a first projection that extends into the airway tube and a second projection that extends into the dispensing tube, said projections being received in their respective tubes with a snug fit.

7. A one-piece dispensing cap as recited in claim 1, wherein said substantially cylindrical base further defines an outwardly-projecting flange on its outer surface.

8. A one-piece dispensing cap as recited in claim 7, wherein there is an abrupt edge at the lower termination point of said dispensing tube, forming an internal ridge, for reducing drips.

9. A one-piece dispensing cap as recited in claim 8, wherein said closure includes a first projection that extends into the airway tube and a second projection that extends into the dispensing tube, said projections being received in their respective tubes with a snug fit.

10. A one-piece dispensing cap as recited in claim 1, wherein there is an abrupt edge at the lower termination point of said dispensing tube, forming an internal ridge, for reducing drips.

11. A one-piece dispensing cap, comprising:

a substantially cylindrical base, defining internal threads in its lower portion and having a substantially vertical axis, and defining an annular ledge on its inner surface above said threads for sealing against a vessel;

a dispensing tube in fluid communication with said base and having an axis which lies at an angle to the axis of the base, said dispensing tube having a lower termination point which lies above the annular ledge;

an elongated airway tube in fluid communication with said base and having a lower termination point which lies above said annular ledge, wherein said dispensing tube and said airway tube lie substantially parallel to each other and define upper termination points which are adjacent to each other, and wherein said elongated airway tube defines a small diameter lower portion, extending for a short distance, and a substantially larger diameter upper portion extending for a substantially greater distance from the small diameter lower portion to the upper termination point of the airway tube; wherein the small diameter lower portion of the airway tube extends downwardly below the lower termination point of the dispensing tube; and wherein the small diameter portion of the airway tube has an upper termination point that is coplanar with the lower termination point of the dispensing tube.

12. A one-piece dispensing cap as recited in claim 11, and further comprising a baffle inside the larger diameter upper portion of said elongated airway tube adjacent said small diameter lower portion.

13. A one-piece dispensing cap as recited in claim 11, wherein said airway tube has a first side adjacent to said dispensing tube and a second side opposite said first side, and wherein said baffle projects upwardly into said larger diameter upper portion from the second side of said small diameter portion.

14. A dispensing cap and bottle combination, comprising:

a bottle having an elongated neck defining a substantially vertical axis, said neck defining external threads at its upper end and terminating at a top edge which defines a top opening;

a seal extending across said top edge and sealing off said top opening; and a one-piece dispensing cap mounted on said bottle, said cap comprising:

a substantially cylindrical base, defining internal threads in its lower portion threaded onto the external threads of the bottle;

said base having a substantially vertical axis and defining an annular ledge on its inner surface above said threads for sealing against the top edge of the bottle;

a dispensing tube in fluid communication with said base and having an axis which lies at an angle to the axis of the base; said dispensing tube having a lower termination point which lies above the annular ledge;

an elongated airway tube in fluid communication with said base and having a lower termination point which lies above said annular ledge, wherein said dispensing tube and said airway tube lie substantially parallel to each other and define upper termination points which are substantially coplanar, and wherein said elongated airway tube defines a small diameter lower portion, extending for a short distance and having a lower termination point below the lower termination point of said dispensing tube, and a substantially larger diameter upper portion extending for a substantially greater distance from the small diameter lower portion to the upper termination point of the airway tube, and further comprising a baffle projecting upwardly from the small diameter lower portion of said airway tube into said larger diameter upper portion; and an integral closure on said cap, defining sealing surfaces which seal against said airway tube and said dispensing tube.

15. A dispensing cap and bottle combination as recited in claim 14, wherein said substantially cylindrical base defines an outwardly-projecting flange on its outer surface.

16. A dispensing cap and bottle combination as recited in claim 15, wherein there is an abrupt edge at the lower termination point of said dispensing tube, forming an internal ridge, for reducing drips.

17. A dispensing cap and bottle combination as recited in claim 16, wherein said integral closure has first and second projections, which are received in said airway tube and said dispensing tube with a snug fit.

18. A one-piece dispensing cap, comprising:

a substantially cylindrical base, defining internal threads in its lower portion and having a substantially vertical axis, and defining an annular ledge on its inner surface above said threads for sealing against a vessel;

a dispensing tube in fluid communication with said base, said dispensing tube having a lower termination point which lies above the annular ledge;

an elongated airway tube in fluid communication with said base and having a lower termination point which lies above said annular ledge;

wherein said dispensing tube and said airway tube define upper termination points that are adjacent to each other so they can be closed with a single closure, and wherein said airway tube has a substantially smaller diameter at its lower termination point than at its upper termination point, and further comprising a baffle projecting upwardly from the small diameter lower portion of said airway tube into said larger diameter upper portion.

19. A one-piece dispensing cap as recited in 18, wherein the majority of the length of said airway tube has a substantially larger diameter than its smaller diameter lower termination point.

20. A one-piece dispensing cap as recited in claim 19, wherein the lower termination point of said airway tube is lower than the lower termination point of said dispensing tube.

* * * * *